US010151089B2

(12) United States Patent
Saruwatari

(10) Patent No.: US 10,151,089 B2
(45) Date of Patent: Dec. 11, 2018

(54) FLUSH VALVE

(71) Applicant: TOTO LTD., Kitakyushu-shi, Fukuoka (JP)

(72) Inventor: Hodaka Saruwatari, Kitakyushu (JP)

(73) Assignee: Toto Ltd. (JP)

( * ) Notice: Subject to any disclaimer, the term of this patent is extended or adjusted under 35 U.S.C. 154(b) by 24 days.

(21) Appl. No.: 15/377,527

(22) Filed: Dec. 13, 2016

(65) Prior Publication Data

US 2017/0175373 A1 Jun. 22, 2017

(30) Foreign Application Priority Data

Dec. 22, 2015 (JP) ..... 2015-249407

(51) Int. Cl.
*E03D 5/01* (2006.01)

(52) U.S. Cl.
CPC ..... *E03D 5/01* (2013.01)

(58) Field of Classification Search
CPC ..... E03D 5/01
USPC ..... 4/432
See application file for complete search history.

(56) References Cited

U.S. PATENT DOCUMENTS 7,253,536 B2 * 8/2007 Fujimoto ..... E03D 3/00 290/43

FOREIGN PATENT DOCUMENTS

WO 2004/088127 A1 10/2004

* cited by examiner

*Primary Examiner* — Tuan N Nguyen
(74) *Attorney, Agent, or Firm* — Baker & Hostetler LLP

(57) ABSTRACT

A flush valve for a toilet, the flush valve including a main valve unit for causing a main valve body to reciprocate between a closed position and an open position in response to pressure inside a back pressure chamber communicating with a primary side flow path thereby opening and closing a flow path between the primary side flow path and the secondary side flow path. The flush valve further including a sub-valve unit having a sub-valve body for opening and closing a bypass flow path connecting the back pressure chamber and the secondary side flow path. The flush valve further including a generating unit disposed on the downstream side of the main valve unit and serving as flow path resistance on the secondary side flow path. Wherein the bypass flow path is connected to the secondary side flow path downstream of the generating unit.

5 Claims, 10 Drawing Sheets

FLUSH VALVE

TECHNICAL FIELD

The present invention relates to a flush valve, and more particularly to a flush valve in which a pressure loss member such as an electrical generator or the like is disposed on the downstream side of a valve body.

BACKGROUND ART

Conventionally known flush valves included self-generating type valves whereby an electrical generating unit for supplying power to the built-in electromagnetic valve is added to a flush valve for supplying water to sanitary equipment such as a toilet (refer to Patent Document 1, for example). The flush valve of Patent Document 1 comprises: a main valve body for opening and closing a flow path between a primary side flow path and a secondary side flow path; a sub-valve body (electromagnetic valve) disposed in a bypass flow path communicating between a back pressure chamber communicating with the primary side flow path and the secondary side flow path; and an electrical generating unit disposed in the secondary side flow path on the downstream side of the main valve body.

In the flush valve, because the closing force pressing on the closing side due to pressure inside the back pressure chamber is normally greater than the opening force pressing on the opening side by pressure inside the primary side flow path, the main valve body is held in the closed position. However, the flush valve is activated in response to manipulation of a switch by a user, or to activation of a human presence sensor.

The start of the flush valve operation results in the sub-valve body being driven by electrical power received from a secondary battery (rechargeable battery) such as a capacitor, displacing the sub-valve body from the closed position to the open position. This puts the bypass flow path in an open state; water in the back pressure chamber passes through the bypass flow path and flows out to the secondary side flow path, which is at a lower pressure than the back pressure chamber. This draining of water from the back pressure chamber causes the closing force which had been impinging on the main valve body to become smaller than the opening force, so the main valve body starts to move toward the open position, and water starts to flow from the primary side flow path to sanitary equipment connected to the secondary side flow path. The flow rate is then maximized when the main valve body reaches an open position.

In the generating unit, water flows to the secondary side flow path, and spouting current therefrom turns an impeller to generate electricity, which is then stored by the secondary battery. The main valve body closes in response when the sub-valve body closes after a predetermined time, thereby stopping spouting.

Note that sanitary equipment such as toilets require the supply of a high force spout flow from the flush valve to reliably discharge waste. Therefore the main valve body must be moved rapidly to an open position (full lift position) at which maximum instantaneous flow can be obtained. This rapid movement can be achieved by quick water draining from the back pressure chamber through operation of the sub-valve body.

PRIOR ART REFERENCES

Patent Citations

Patent Document 1: WO2004/088127

SUMMARY OF THE INVENTION

Problems to be Solved by the Invention

However, because of natural discharge of the secondary battery, this type of self-generating flush valve requires setting a minimum average number of flushes per day. Therefore when sanitary equipment is not used over a long period, the secondary battery may become unable to supply sufficient power to drive the sub-valve body, preventing supply of the specified maximum flow rate to the sanitary equipment, or even preventing the supply of flush water altogether.

A conceivable solution to such a problem is to reduce power consumption. For example, reducing the drive voltage to the electromagnetic valve and the drive device thereof (e.g., from a 5V to a 3V drive) can extend the period over which sufficient drive power can be assured to the sub-valve body when not in use. However this reduction in voltage causes the electromagnetic valve (sub-valve body) output power to drop, reducing operating speed. Since this also causes the operating speed of the main valve body to drop, rapid water draining performance is not attained, resulting in the further problem that it may not be possible to supply flush water at a high force.

The present invention is to solve such problems, and the object thereof is to provide a flush valve capable of maintaining a high force flush water.

Means for Resolving Problems

To solve the above-described problem, the present invention is a flush valve configured to be connected to sanitary equipment on the downstream side, the flush valve comprising: a main valve unit for causing a main valve body to reciprocate between a closed position and an open position in response to pressure in a back pressure chamber communicating with a primary side flow path, thereby opening and closing a flow path between the primary side flow path and the secondary side flow path; a sub-valve unit having a sub-valve body for opening and closing a bypass flow path connecting the back pressure chamber and the secondary side flow path; and a pressure loss member, disposed on the downstream side of the main valve body and serving as flow resistance on the secondary side flow path; wherein the bypass flow path is connected to the secondary side flow path downstream of the pressure loss member.

In the invention thus constituted, water flowing into the secondary side flow path from the primary side flow path as a result of the opening operation of the main valve body passes through the main valve unit, then acts on the pressure loss member, which is a flow path resistance on the secondary side flow path. Water which has passed through the main valve unit can thus more easily accumulate on the upstream side of the pressure loss member. On the other hand, the bypass flow path communicates between the back pressure chamber and the secondary side flow path, and water flowing via the bypass flow path into the secondary side flow path merges with the secondary side flow path further downstream than the pressure loss member. By this constitution, in the present invention the pressure loss member does not become a flow path resistance opposing the flow of water through the bypass flow path, and the water flow through the bypass flow path does not act on the pressure loss member.

Therefore in the present invention, because water does not accumulate close to the merging point of the bypass flow path and the secondary side flow path, the water flow can be smoothly guided from the back pressure chamber, through the bypass flow path, to the secondary side flow path. In such an invention, because water can be quickly evacuated from the back pressure chamber, the main valve body can be quickly displaced from the closed position to the open position (full tilt position), so that the spout flow rate can be increased to the maximum instantaneous flow rate in a short period after start of activation, enabling the supply of a high force spout water flow to the sanitary equipment.

The present invention preferably further comprises a reverse flow prevention valve to prevent reverse flow to the pressure loss member, and the bypass flow path is connected to the secondary side flow path between the pressure loss member and the reverse flow prevention valve.

In the invention thus constituted, even if water containing foreign objects from the sanitary equipment flows in reverse toward the upstream side, that reverse flow is stopped by the reverse flow prevention valve. Thus admixing of foreign objects into the pressure loss member of the main valve unit, or passing through the bypass flow path of foreign objects and admixing into the sub-valve body are suppressed, and equipment failure can be prevented.

Also, in the present invention the volume of the bypass flow path is preferably larger than the reduced volume of the back pressure chamber, which reduces due to movement of the main valve body from the closed position to the open position.

In the invention thus constituted, when the main valve body moves by a certain distance from the closed position toward the open direction and reaches the open position, flush water is forced out from the back pressure chamber in the amount of the reduced volume equal to the distance multiplied by the effective surface area of the main valve body on the side of the back pressure chamber. In the present invention, the flow path volume inside the bypass flow path is larger than this reduced volume, therefore when the main valve body moves from the closed position to the open position, water which had accumulated in the back pressure chamber can be quickly discharged into the bypass flow path. Since the main valve body can thus be quickly and smoothly moved from the closed position to the open position during the opening operation of the main valve body, the spout flow rate to the sanitary equipment can be raised to the maximum instantaneous flow rate in a short time after the start of the opening operation.

Also, in the present invention the bypass flow path is preferably connected to the secondary side flow path only downstream of the pressure loss member.

In the present invention thus constituted, water flow through the bypass flow path does not pass through the pressure loss member, and does not act on the pressure loss member. The water flow through the bypass flow path is therefore not prone to accumulate inside the secondary side flow path close to the merge point, and water in the back pressure chamber can be quickly and reliably drained through the bypass flow path to the secondary side flow path. Thus in the present invention the spout flow can be increased to the maximum instantaneous flow rate in a short time, and a high force spout water flow can be supplied to the sanitary equipment.

In the present invention, preferably, the pressure loss member is an electrical generating unit comprising: an impeller, disposed inside the secondary side flow path and capable of rotating about the rotary shaft extending across the secondary side flow path, a flow deflector for causing the flow out of the main valve unit to impact on one side of the impeller relative to the rotary shaft as seen from the upstream side, and an impeller cover for covering the other side of the impeller relative to the rotary shaft; and configured to generate electricity through the rotation of the impeller, wherein the bypass flow path is connected to the secondary side flow path on the other side of the impeller, where the impeller cover is disposed.

In the invention thus constituted, by providing the flow deflector and the impeller cover, the side portion of the impeller cover in the secondary side flow path functions as a bypass flow path extending portion, and thus the bypass flow path is effectively extended to the downstream end of the impeller cover. Thus in the present invention the bypass flow path can in effect be made to merge with the secondary side flow path on the downstream side of the generating unit. Therefore in the present invention, since the water flow passing through the bypass flow path does not act to rotate the impeller in the reverse direction, the generating efficiency of the generating unit is not reduced.

Also, in the present invention the bypass flow path is connected to the secondary side flow path after extending to the position of the impeller. Therefore in the present invention the length of the bypass flow path is shortened, and the overall size of the apparatus can be reduced compared to a constitution in which the bypass flow path is connected to the secondary side flow path after extending to the downstream side of the impeller.

Effect of the Invention

The present invention enables the provision of a flush valve capable of maintaining a high force flush water.

EMBODIMENTS OF THE INVENTION

Next, referring to FIGS. 1 through 10, we explain a flush valve according to an embodiment of the present invention.

Figure 1:
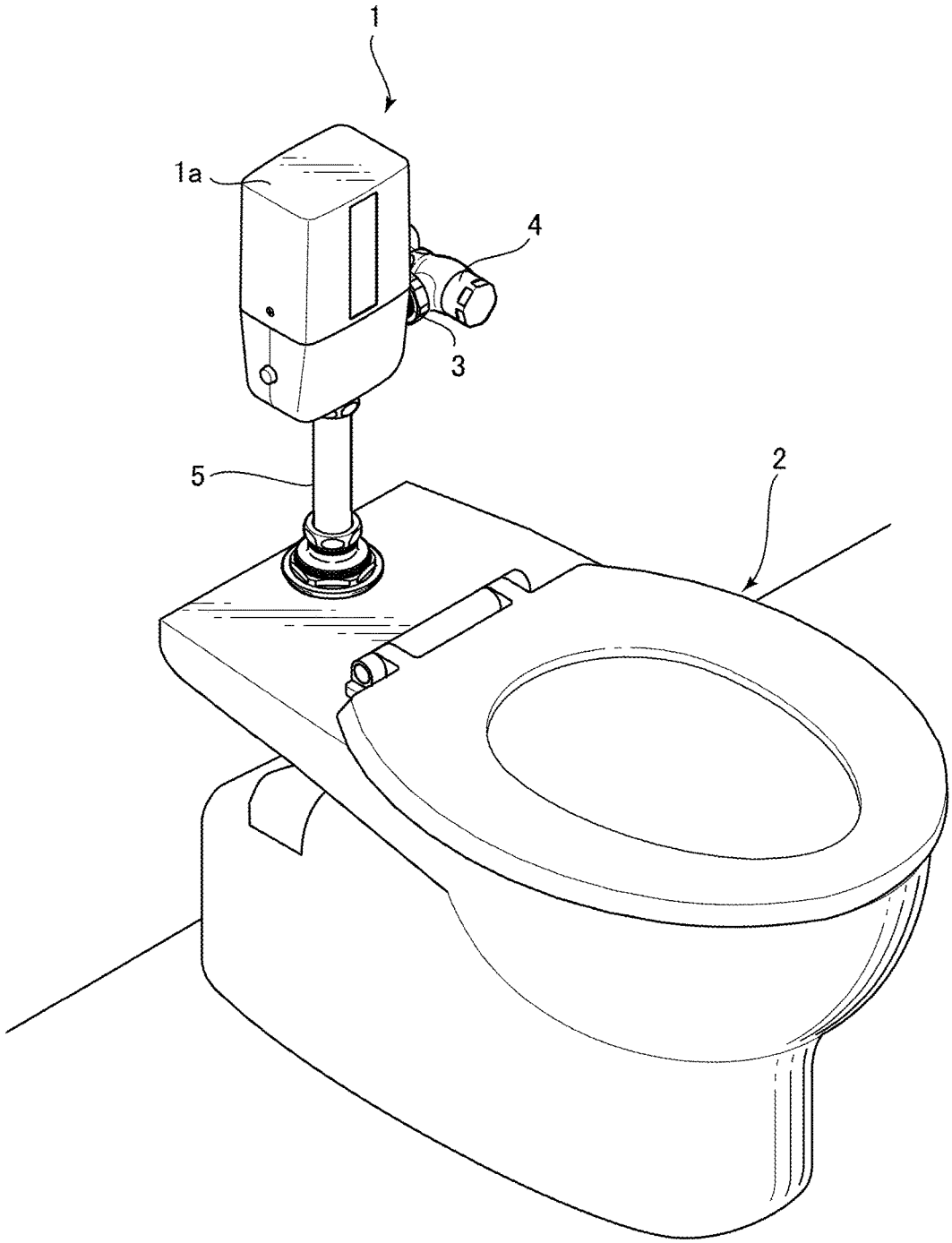
FIG. 1 is an external view of a flush valve according to an embodiment of the invention.

As shown in FIG. 1, the flush valve 1 of the present embodiment is applied to a toilet 2 as sanitary equipment. The flush valve 1 is connected on the intake side to a supply pipe 3 and a stop water plug 4, and the outlet side thereof is connected through a discharge pipe 5 to the toilet 2. Note that the sanitary equipment includes toilets, urinals, water faucet, and the like.

Figure 2:
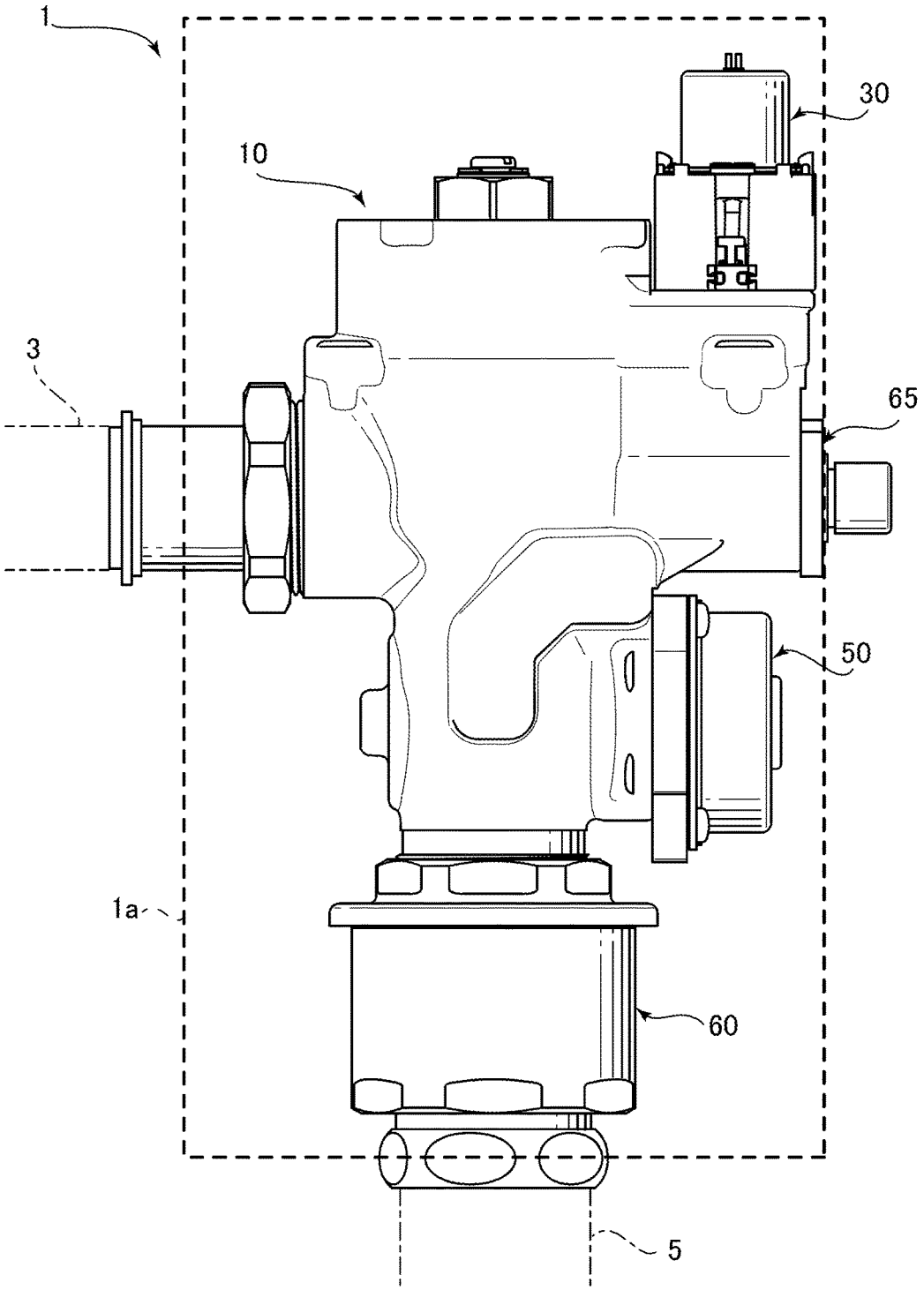
FIG. 2 is a side view of a flush valve according to an embodiment of the invention.
Figure 3:
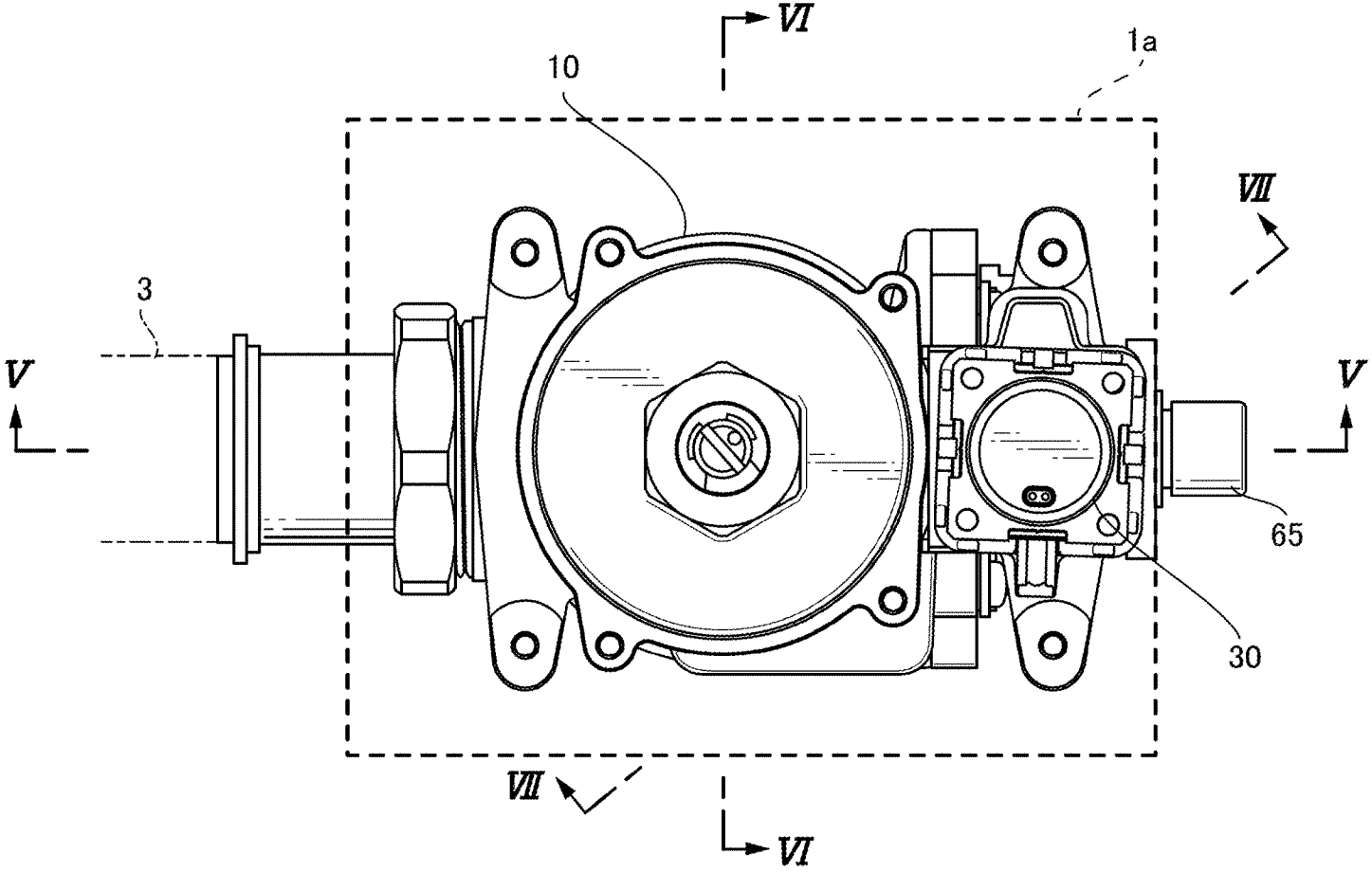
FIG. 3 is a plan view of a flush valve according to an embodiment of the invention.

As shown in FIGS. 2 and 3, the flush valve 1 comprises: a main valve unit 10, a sub-valve unit 30, a generating unit 50, a reverse flow prevention valve 60, and a manual valve unit 65; all of which are housed in a case 1*a*. The supply pipe 3 is connected to the main valve unit 10, and the discharge pipe 5 is connected to the reverse flow prevention valve 60.

Figure 4:
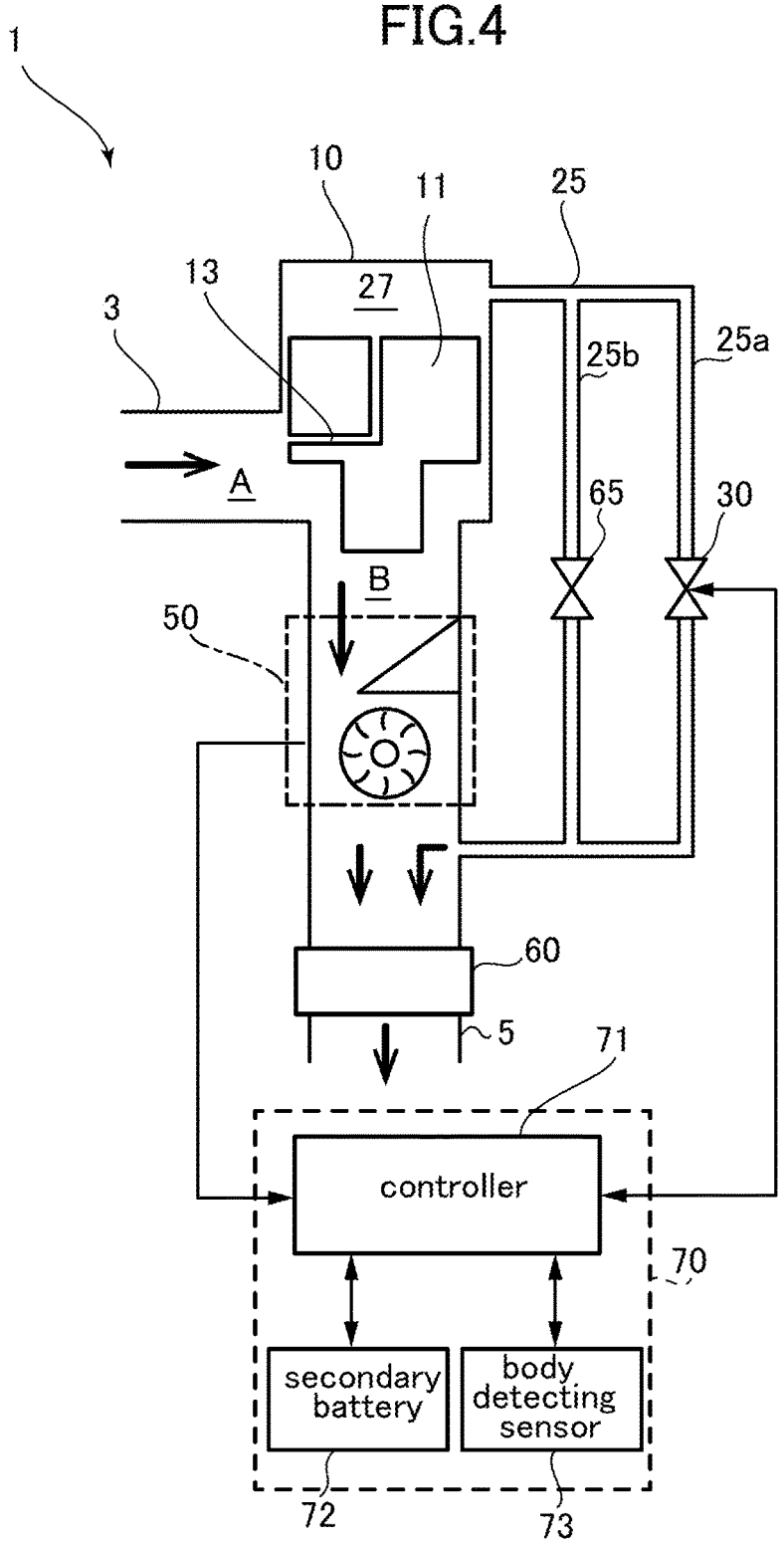
FIG. 4 is an explanatory view showing the constitution of a flush valve according to an embodiment of the invention.

As shown in FIG. 4, the flush valve 1 comprises a control device 70, being an electrical constituent part. The control device 70 comprises: a controller 71, a secondary battery 72, and a body detecting sensor 73. The secondary battery 72 is constituted to supply power to the control device 70; the secondary battery 72 powers the controller 71 and also powers the body detecting sensor 73 through the controller 71.

The body detecting sensor 73 uses an infrared sensor or the like to detect whether a user is using the toilet 2, outputting a detection signal to the controller 71. The controller 71, depending on the detection signal, outputs an open drive signal to the sub-valve unit 30 at a predetermined time (e.g., when the user has moved away from the toilet 2 after use), and further outputs a close drive signal after a further predetermined time. The sub-valve unit 30, in response to the open and close drive signals, electromagnetically opens and closes an internal pilot valve, in turn opening and closing the sub-valve body 31 (see FIG. 5).

When the sub-valve unit 30 enters an open state, water is drained from the back pressure chamber 27, so that the main valve body 11 of the main valve unit 10 moves from the closed position to the open position and flush water is supplied to the toilet 2. At this point the generating unit 50 operates and generates electricity to charge the secondary battery 72 through the controller 71.

Note that in addition to the secondary battery 72, a replaceable primary battery may also be provided on the flush valve 1 for backup. The flush valve 1 may also be capable of operating to supply flush water to the toilet 2 by a user flush switch operation.

Figure 5:
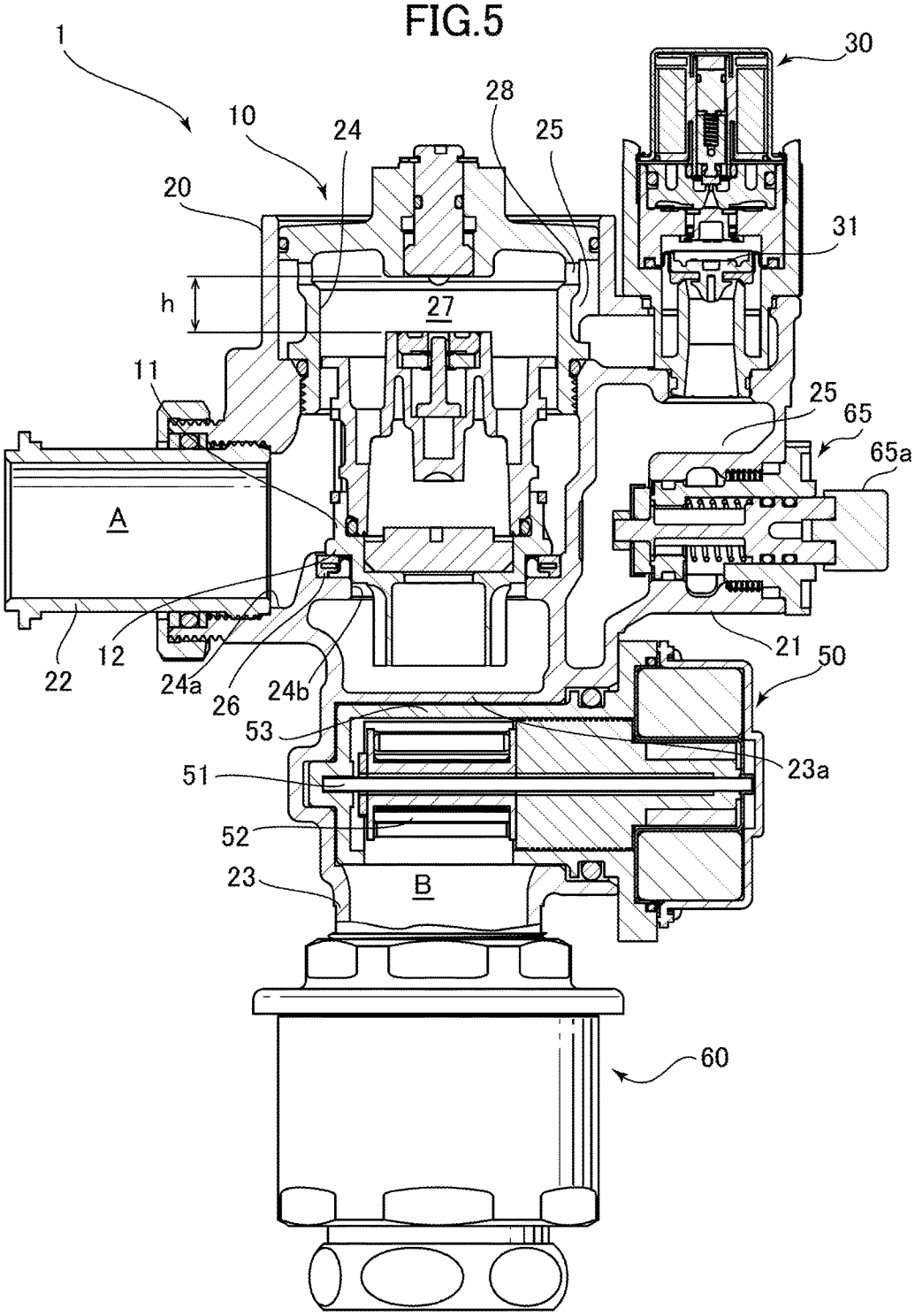
FIG. 5 is a cross section through V-V when water is stopped.

As shown in FIG. 5, the main valve unit 10 comprises a main valve body 11 and a housing 20. The housing 20 comprises a housing main unit 21, an intake pipe 22, and an outlet pipe 23. Also, a main valve container 24 and a bypass flow path 25 are formed on the housing main unit 21. The main valve body 11 is housed within the main valve container 24, and is constituted to reciprocate between the closed position and the open position within the main valve container 24.

An intake opening 24*a* communicating with the intake pipe 22 and a main valve hole 24*b* communicating with the outlet pipe 23 are formed on the main valve container 24. An annular valve seat 26 is formed on the edge portion of the main valve hole 24*b*; in the closed position of the main valve body 11 (see FIG. 5), contact by the valve portion 12 of the main valve body 11 with the valve seat 26 results in blocking of the main valve hole 24*b* by the main valve body 11, thereby dividing the primary side flow path A inside the intake pipe 22 and the secondary side flow path B inside the outlet pipe 23. In the open position (see FIG. 9), meanwhile, the main valve hole 24*b* is released by the disjoining of the valve portion 12 of the main valve body 11 from the valve seat 26, causing the primary side flow path A to communicate with the secondary side flow path B.

The back pressure chamber 27 is formed in the upper space of the main valve body 11 of the space inside the main valve container 24. A communication hole 13 (see FIG. 4) is formed in the main valve body 11 in order to cause the primary side flow path A and the back pressure chamber 27 to communicate. Therefore when the main valve body 11 is in a closed state, the primary pressure of supplied water is applied to the back pressure chamber 27 through the communication hole 13. The primary pressure applied to the main valve body 11 from the primary side flow path A causes the main valve body 11 to receive an upward (opening direction) opening force. At the same time, pressure inside the back pressure chamber 27 results in the main valve body 11 receiving a downward (closing direction) closing force. At this point, because the pressure receiving surface area of the main valve body 11, to which a primary pressure is applied on the back pressure chamber 27 side, is greater than the pressure receiving surface area of the main valve body 11 to which a primary pressure is applied on the primary side flow path A, the closing force is greater than the opening force resulting from the pressure receiving surface area difference, such that the main valve body 11 is held in a closed position.

Figure 6:
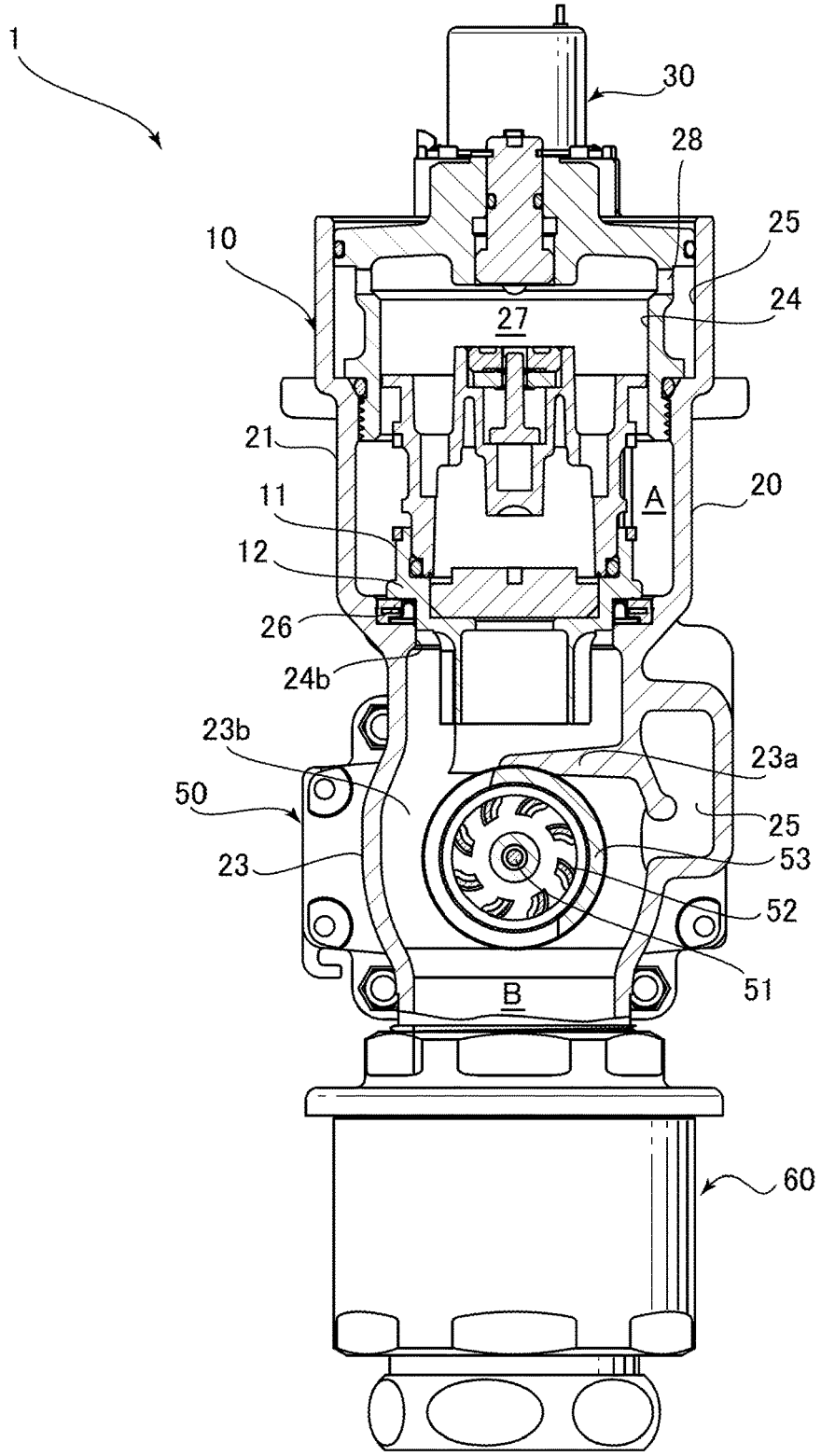
FIG. 6 is a cross section through VI-VI when water is stopped.
Figure 7:
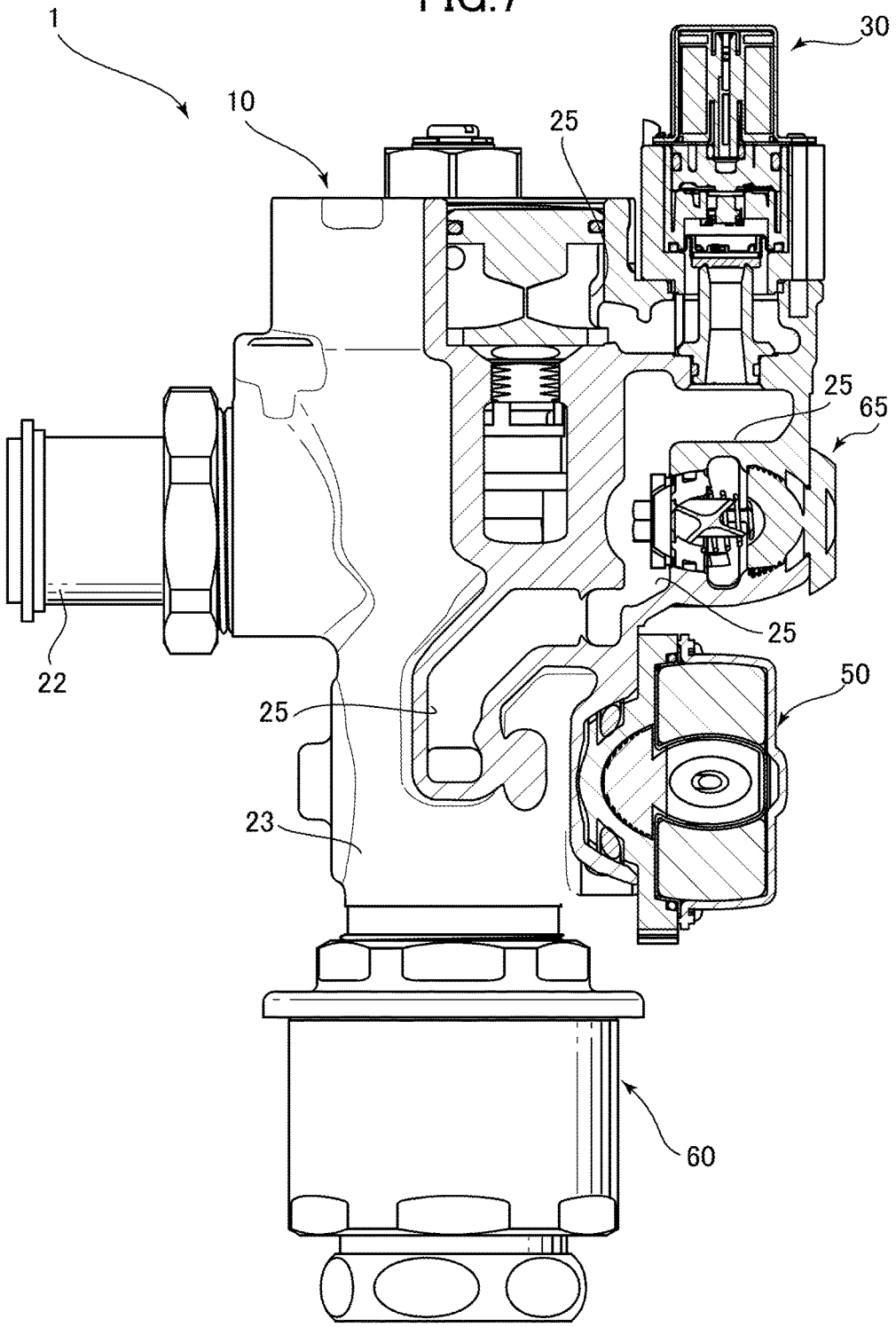
FIG. 7 is a cross section through VII-VII when water is stopped.

The bypass flow path 25, as shown in FIG. 4, connects the back pressure chamber 27 and the secondary side flow path B. Specifically, the bypass flow path 25, as shown in FIG. 5, communicates with the back pressure chamber 27 using holes 28 formed on the top portion of the main valve container 24, and extends through the right side of the main valve container 24 to below the main valve container 24. In addition, as shown in FIGS. 6 and 7, the bypass flow path 25, after detouring from below the main valve container 24 to one side (the right side in FIG. 6; the front side on the paper in FIG. 7), is joined to the outlet pipe 23. The bypass flow path 25, as shown in FIG. 4, is branched into a first bypass flow path 25*a* in which the sub-valve unit 30 is disposed, and a second bypass flow path 25*b* in which the manual valve unit 65 is disposed.

The sub-valve unit 30, as shown in FIG. 5, is an electromagnetic valve (solenoid valve) attached at the top portion of the housing main unit 21 for opening and closing the first bypass flow path 25*a*. The sub-valve unit 30 has a sub-valve body 31 capable of opening and closing the first bypass flow path 25*a*, and an electromagnetically driven pilot valve; these are normally held in the closed state. The sub-valve unit 30 is a self-holding electromagnetic valve; by receiving the open drive signal or close drive signal from the controller 71 which has received the detection signal from the body detecting sensor 73, it is able to allow passage through or block the first bypass flow path 25*a*.

Specifically, the sub-valve body 31 operates on the same operating principle as the main valve unit 10 and main valve body 11, so that when the pilot valve is driven to the open position by an electrical signal, the opening force of the sub-valve body 31 exceeds the closing force, displacing the sub-valve body 31 to an open state and permitting passage through the first bypass flow path 25*a*; on the other hand, when the pilot valve is driven to the closed position by an electrical signal, the closing force of the sub-valve body 31 exceeds the opening force, so the sub-valve body 31 is displaced to a closed state, blocking the first bypass flow path 25*a*.

In addition, because the sub-valve unit 30 is a self-holding electromagnetic valve, it performs the opening and closing operation in response to an open drive signal or a close drive signal, but without such limitation it may also be an electromagnetic valve of the type which holds the open state only for the period during which it is receiving a drive signal.

The manual valve unit 65, as shown in FIG. 5, is attached to the housing main unit 21 at the bottom side of the sub-valve unit 30. The manual valve unit 65 is normally in a closed state, but opening and closing of the second bypass flow path 25*b* may be accomplished by manipulating a manual operating switch 65*a*.

The generating unit 50, as shown in FIGS. 5 and 6, is disposed on the outlet pipe 23, and is constituted to include: a rotary shaft 51; an impeller 52 attached to one end of the rotary shaft 51; a impeller cover 53 covering a portion of the impeller 52; a permanent magnet, an electromagnetic coil, etc. attached to the other end of the rotary shaft 51; and a flow deflector 23*a*. In the generating unit 50, the rotary shaft 51 is disposed perpendicular to the flow path direction of the outlet pipe 23 to cross the flow path of the outlet pipe 23; spout water flow causes the impeller 52 to rotate and generate electricity so that the secondary battery 72 can be charged.

As shown in FIG. 6, the flow deflector 23*a* is placed on the outlet pipe 23 so as to bulge out toward the flow path center from the right side inner wall. The flow deflector 23*a* functions to cause the flush water flow spouted from the main valve hole 24*b* to impact one side of the impeller 52 relative to the rotary shaft 51 (the left half as seen in FIG. 6) as seen from the upstream side. The impeller cover 53 is placed around the impeller 52 so as to cover a portion of the outside circumference on the other side of the impeller 52 relative to the rotary shaft 51 (the right half as seen in FIG. 6), i.e., the location covered by the flow deflector 23*a*, so that flush water does not impact it. Note that in the present embodiment the flow deflector 23*a* is formed as an integral unit with the outlet pipe 23, but it may also be placed on the generating unit 50. For example, it may also be constituted so that the flow deflector 23*a* is integrally formed with the impeller cover 53, and extends from the impeller cover 53 toward the inside wall of the outlet pipe 23.

The generating unit 50 (especially the flow deflector 23*a*, impeller 52, and impeller cover 53) are disposed to project into the secondary side flow path B of the outlet pipe 23, and the secondary side flow path B is substantially narrowly constricted. Therefore a constricting portion 23*b* with a narrow flow path is formed in the part of the outlet pipe 23 where the generating unit 50 is disposed. The generating unit 50 thus forms a pressure loss member constituting flow path resistance.

The reverse flow prevention valve 60, as shown in FIGS. 5 and 6, is attached at one end to the end portion of the outlet pipe 23, and at the other end is connected to the discharge pipe 5 (see FIG. 1). The reverse flow prevention valve 60 prevents reverse flows from the discharge pipe 5 side, and prevents the influx and adhering of waste on the inside of the flush valve 1.

Next we explain the operation of the flush valve 1 in the present embodiment. As shown in FIGS. 5 and 6, because the main valve body 11 is maintained in a closed position based on the pressure receiving surface area differential when water is stopped, the main valve hole 24*b* is closed by the main valve body 11, and the primary side flow path A is blocked off from the secondary side flow path B. In this state, a detection signal is output from the body detecting sensor 73 when a user uses the toilet 2, and the controller 71 receives this detection signal and outputs an open drive signal to the sub-valve unit 30.

When the sub-valve unit 30 receives the open drive signal, it moves the pilot valve electromagnetically to the open position, placing the sub-valve body 31 in an open state. A portion of the flush water which had been filling the back pressure chamber 27 thus flows through the bypass flow path 25 and out to the secondary side flow path B (see the dotted line arrow in FIGS. 8 and 9). Water is by this means drained from the back pressure chamber 27, therefore the internal pressure in the back pressure chamber 27 drops and the closing force pushing the main valve body 11 onto the valve seat 26 becomes smaller than the opening force for opening the main valve body 11 through application of primary pressure, so the main valve body 11 begins to move in the open direction.

Figure 8:
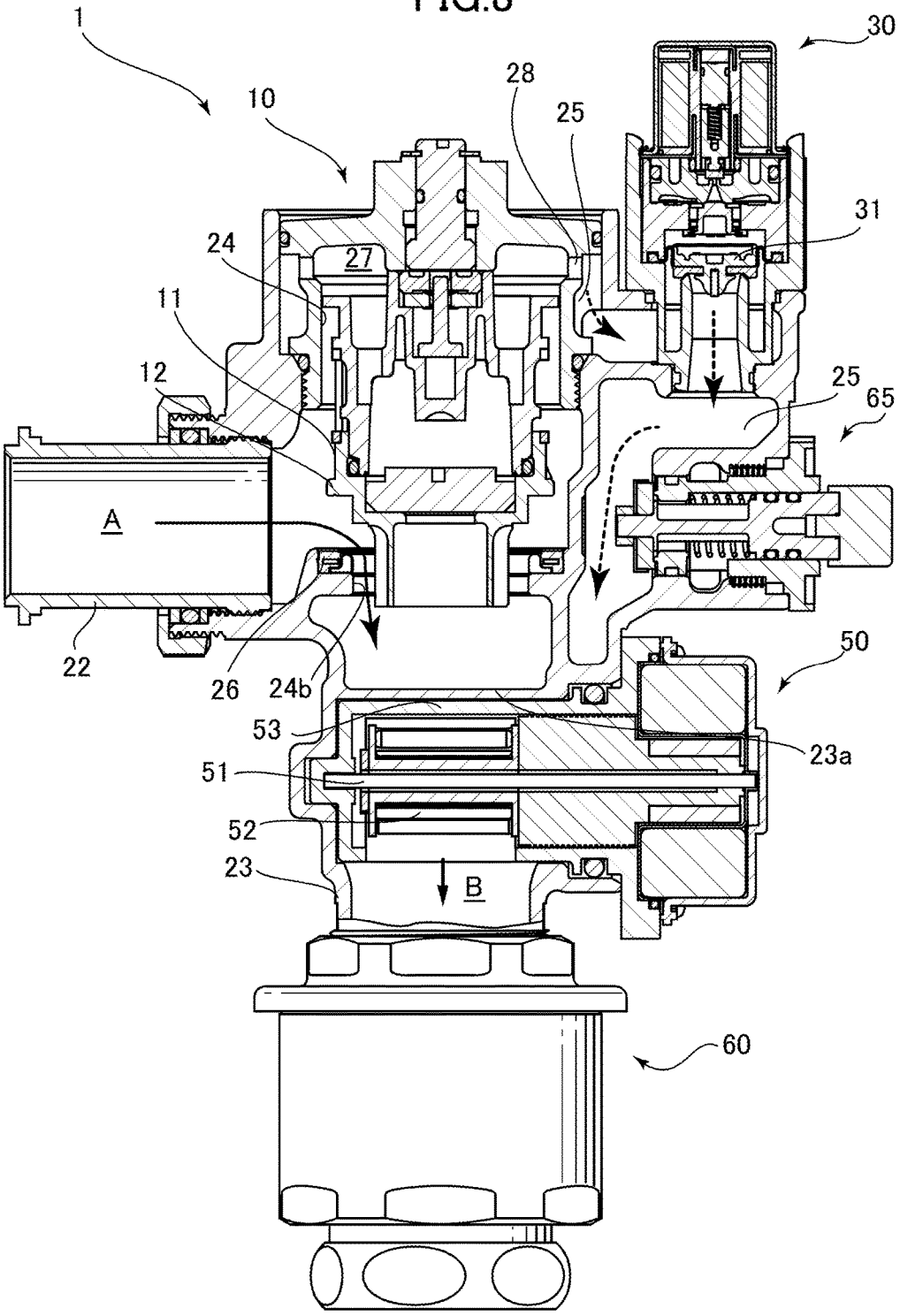
FIG. 8 is a cross section similar to FIG. 5 when water is spouted.
Figure 9:
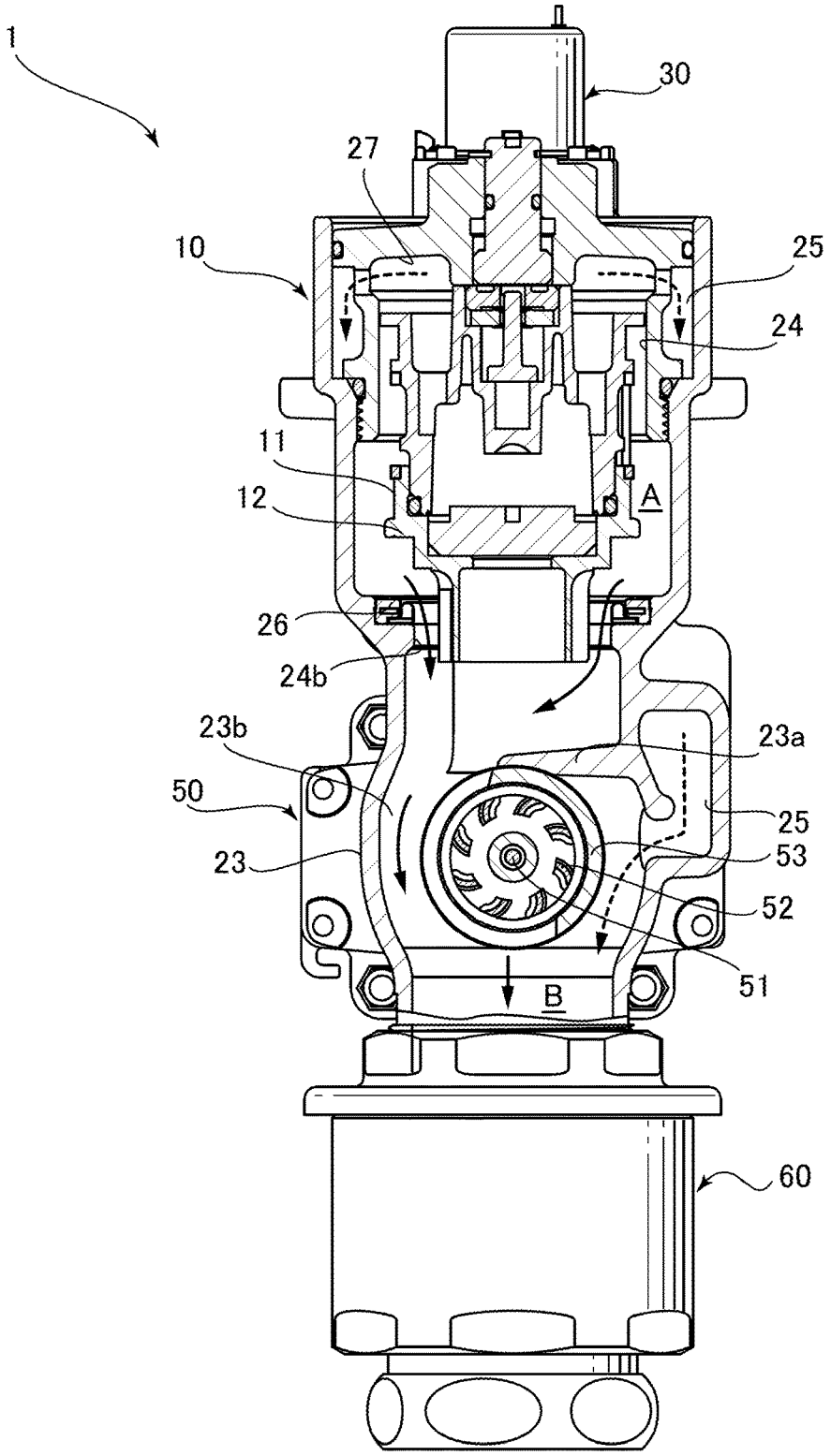
FIG. 9 is a cross section similar to FIG. 6 when water is spouted.

As shown in FIGS. 8 and 9, the effective water passageway diameter of the main valve hole 24*b* is maximized when the main valve body 11 moves to the open position (full lift position), therefore flush water is supplied to the toilet 2 at maximum instantaneous flow rate (e.g., 100 L/min) (see the solid arrows in FIGS. 8 and 9). At that point, electricity is generated by the generating unit 50, charging the secondary battery 72. Note also that the flow rate of flush water flowing in the bypass flow path 25 when the pilot valve and the sub-valve body 31 of the sub-valve unit 30 are displaced to the open position is extremely small (e.g., 1 L/min or less) compared to the instantaneous maximum flow rate passing through the main valve hole 24*b*.

When the controller 71 outputs a close drive signal after a predetermined time, the sub-valve unit 30 receives this close drive signal and, by causing the pilot valve and the sub-valve body 31 to move to the closed position, closes the bypass flow path 25. Pressure in the back pressure chamber 27 is thus raised by flush water supplied from primary side flow path A through the communication hole 13 to the back pressure chamber 27 such that the closing force resulting from pressure inside the back pressure chamber 27 exceeds the opening force, and the main valve body 11 moves toward the closed position. Supply of flush water is completely stopped when the main valve body 11 reaches the closed position (see FIGS. 5 and 6).

Next we explain the operation of the flush valve 1 in the present embodiment. As a comparative example, we first explain a comparative constitution in which, unlike the present embodiment, the bypass flow path 25 merges with the secondary side flow path B upstream of the pressure loss member (generating unit 50). In this comparative example, the sub-valve body is displaced to the open position and flush water begins to flow from the back pressure chamber through the bypass flow path to the secondary side flow path when the sub-valve unit operates in a stopped water state. At this point, because the generating unit serves as a flow path resistance, flush water can more easily fill the secondary side flow path on the upstream side of the generating unit.

Displacement of the main valve body from the closed state to the open state starts when the sub-valve body goes to an open state, therefore the main valve body goes from a closed state to a partially open state at the start of operation. Therefore in addition to flush water from the sub-valve body side, flush water from the main valve body side flows into the secondary side flow path, and can more easily fill the secondary side flow path on the upstream side of the generating unit.

Thus when flush water begins to accumulate in the secondary side flow path on the upstream side of the generating unit, inflow of flush water into the secondary side flow path from the bypass flow path is interrupted, impeding the smooth inflow of flush water from the bypass flow path into the secondary side flow path. There is also a risk that flush water will flow in reverse from the secondary side flow path toward the bypass flow path.

Therefore in contrast to the present embodiment, there is a risk in the comparative example, where the bypass flow path merges with the secondary side flow path upstream of the generating unit, that water will have difficulty draining from the back pressure chamber through the bypass flow path, and water draining performance will degrade. The time required for the main valve to reach the open position (full lift position) from the closed position after start of operation will thus lengthen, resulting in the risk of a shortened period of flush water supply at the maximum instantaneous flow rate, or an inability to achieve the maximum instantaneous flow rate.

Figure 10:
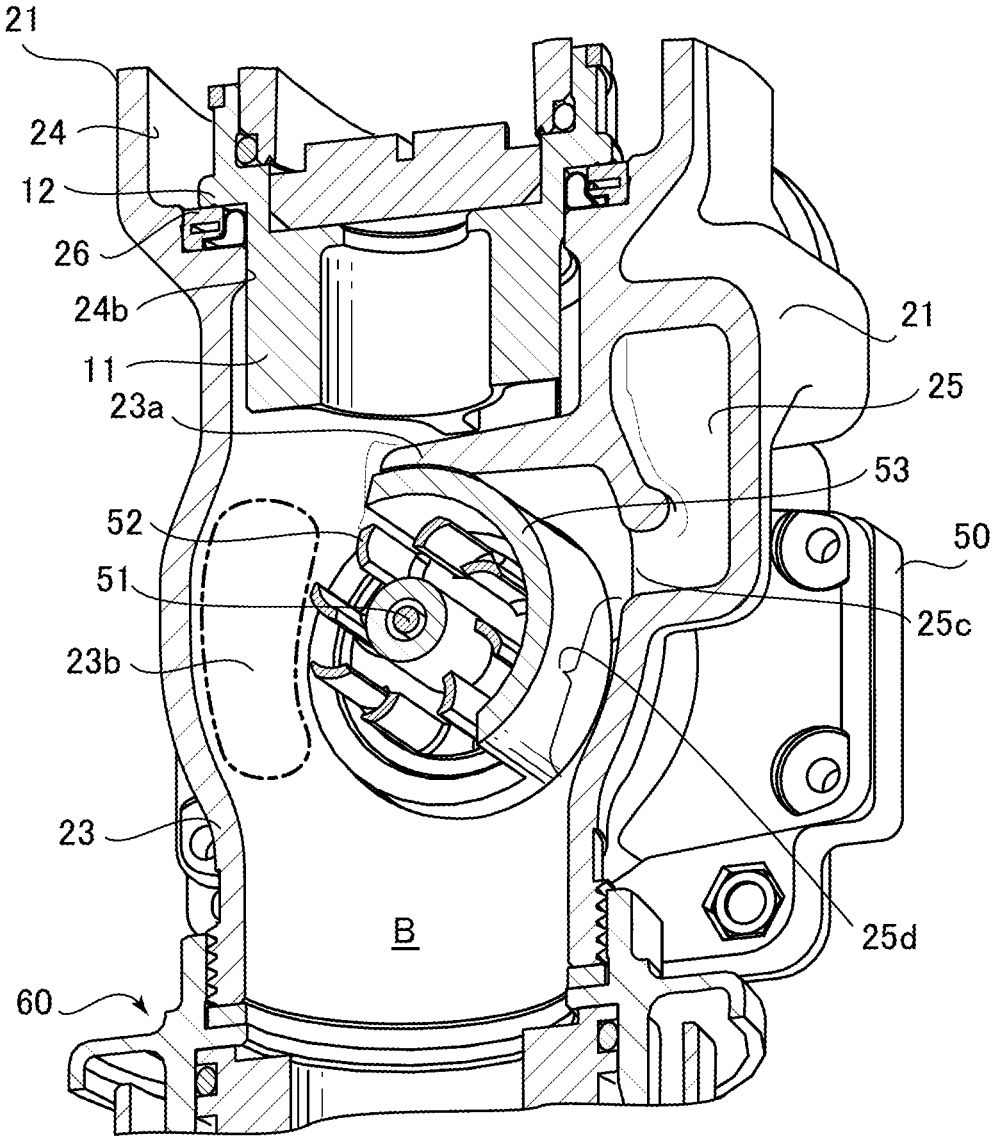
FIG. 10 is a cross section perspective view of a flush valve secondary side flow path according to an embodiment of the present invention.

On the other hand, in the flush valve 1 of the present embodiment, as shown in FIG. 10, the bypass flow path 25 is connected to the outlet pipe 23 forming the secondary side flow path B, but flush water passing through the bypass flow path 25 and flowing into the outlet pipe 23 merges with the secondary side flow path B downstream of the active area of the generating unit 50. I.e., the bypass flow path 25 is effectively connected to the outlet pipe 23 downstream of the generating unit 50. As a result, in the present embodiment the generating unit 50, which is a pressure loss member, does not become a flow path resistance relative to the flush water flow through the bypass flow path 25, and the flush water flow through the bypass flow path 25 does not act on the generating unit 50.

Hence in the present embodiment, because flush water does not accumulate close to the merge point of the bypass flow path 25 and the secondary side flow path B, flush water can be smoothly guided from the back pressure chamber 27 through the bypass flow path 25 to the secondary side flow path B owing to the internal pressure differential between the back pressure chamber 27 and the secondary side flow path B downstream of the generating unit 50, hence water can be quickly drained from the back pressure chamber 27. For this reason, in the present embodiment the main valve body 11 can be quickly displaced from the closed position to the open position (full lift position), thereby enabling the spout water flow rate to be increased to maximum instantaneous flow rate in a short period from start of operation, enabling the supply of a high force spout flow to the toilet 2.

Note that in the present embodiment there is no other pressure loss member on the secondary side flow path B from the main valve hole 24*b* to the generating unit 50, and the generating unit 50 is the first pressure loss member. Also, in the present embodiment the pressure loss member is the generating unit 50, but without limitation thereto the pressure loss member may be another member (e.g., a flow rate sensor, etc.).

In addition, because the outlet hole 25*c* of the bypass flow path 25 opens on the side of the impeller 52, the bypass flow path 25 is not, precisely speaking, connected to the outlet pipe 23 on the downstream side of the generating unit 50. However in the present embodiment the impeller cover 53 is disposed on the side of the impeller 52 facing the bypass flow path 25, therefore flush water passing through the bypass flow path 25 merges with the secondary side flow path B at the bottom end of the impeller cover 53 (see FIG. 10). I.e., flush water passing through the bypass flow path 25 does not act on the impeller 52 of the generating unit 50 in the part where the impeller cover 53 is disposed. Hence in the present embodiment a partial space in the secondary side flow path B surrounded by the impeller cover 53 and the inner wall of the outlet pipe 23 functions as the bypass flow path extending portion 25*d* of the bypass flow path 25, so that the bypass flow path 25 is effectively extended to the bottom end of the impeller cover 53.

In the present embodiment, the impeller cover 53 is placed and the bypass flow path 25 is extended to make effective use of the right side space of the impeller 52 (see FIG. 10), but without limitation thereto, the outlet hole 25*c* of the bypass flow path 25 may also be placed on the physical downstream side of the generating unit 50 or the impeller 52 in the outlet pipe 23.

Also, in the present embodiment the reverse flow prevention valve 60 is connected to the outlet pipe 23 further downstream than the merge point of the bypass flow path 25 and outlet pipe 23, and the generating unit 50. Therefore even if flush water containing foreign objects flows in reverse toward the upstream side of the toilet 2 as sanitary equipment, the reverse flow prevention valve 60 blocks that reverse flow. Adhesion of foreign objects to the generating unit 50, or admixing of foreign objects through the main valve hole 24*b* or the bypass flow path 25 into the main valve unit 10 or the sub-valve unit 30 can thus be suppressed, and equipment malfunctions prevented.

In the present embodiment the volume of the bypass flow path 25 from the holes 28 to the outlet hole 25*c* is constituted to be larger than the reduced volume of the back pressure chamber 27, which is reduced by movement of the main valve body 11 from the closed position to the open position. I.e., when the main valve body 11 moves upward by the distance h from the closed position (see FIG. 5) and reaches the open position (see FIG. 8), the reduced volume of flush water equal to the distance h multiplied by the effective surface area of the main valve body 11 on the side of the back pressure chamber 27 is forced out from the back pressure chamber 27.

In the present embodiment, the flow path volume inside the bypass flow path 25 is larger than this reduced volume, therefore when the main valve body 11 moves from the closed position to the open position, flush water which had accumulated in the back pressure chamber 27 can be quickly discharged into the bypass flow path 25. Since the main valve body 11 can thus be quickly and smoothly moved from the closed position to the open position during the opening operation of the main valve body 11, the spout flow rate to the toilet 2 can be raised to the maximum instantaneous flow rate in a short time after the start of the opening operation.

Also, because in the present embodiment the bypass flow path 25 is connected to the secondary side flow path B only on the downstream side of the generating unit 50, which is a pressure loss member (see FIGS. 4, 10), flush water which has passed through the bypass flow path 25 does not transit the pressure loss member (generating unit 50). Therefore flush water through the bypass flow path 25 is not prone to accumulate inside the secondary side flow path B close to the merge point of the bypass flow path 25 and the secondary side flow path B, so flush water inside the back pressure chamber 27 can be quickly and reliably drained through the bypass flow path 25 to the secondary side flow path B. Thus in the present embodiment the spout flow rate can be increased to the maximum instantaneous flow rate in a short time period.

Also, in the present embodiment the generating unit 50 is disposed inside the secondary side flow path B and comprises an impeller 52 rotated by flush water flowing in the secondary side flow path B. The flow deflector 23*a* is provided such that flush water impacts one side of the impeller 52 (the left side in FIG. 10) relative to the rotary shaft 51 as seen from upstream. In addition, the impeller cover 53 is placed on the impeller 52 so as to cover the other side (the right side of FIG. 10) where the flow deflector 23*a* is disposed. The outlet hole 25*c* of the bypass flow path 25 is formed on the side of the impeller cover 53 in the outlet pipe 23.

Hence in the present embodiment, because of the provision of the flow deflector 23*a* and the impeller cover 53, the side of the impeller cover 53 within the secondary side flow path B functions as the bypass flow path extending portion 25*d*, and the bypass flow path 25 is effectively extended to the downstream end of the impeller cover 53. Thus in the present embodiment the bypass flow path 25 can in effect be made to merge with the secondary side flow path B on the downstream side of the generating unit 50. Therefore in the present embodiment flush water which has passed through the bypass flow path 25 does not act to rotate the impeller 52 in a reverse direction even if flush water merges inside the outlet pipe 23 at the outlet hole 25*c*, and hence flush water does not reduce the generating efficiency of the generating unit 50.

Also, in the present embodiment, as described above, the bypass flow path 25, after extending to the position of the impeller 52, is connected at the outlet hole 25*c* to the outlet pipe 23. Compared to a constitution in which the bypass flow path 25 is connected to the outlet pipe 23 after extending to the downstream side of the impeller 52, therefore, in the present embodiment the length of the bypass flow path 25 is shortened, and the overall size of the apparatus can be reduced.

EXPLANATION OF REFERENCE NUMERALS

1: flush valve
1*a*: case
2: toilet
3: supply pipe
4: stop water plug
5: discharge pipe
10: main valve unit
11: main valve body
12: valve portion
13: communication hole
20: housing
21: housing main unit
22: intake pipe
23: outlet pipe
23*a*: flow deflector
23*b*: constricting portion
24: main valve container
24*a*: intake opening
24*b*: main valve hole
25: bypass flow path
25*a*: first bypass flow path
25*b*: second bypass flow path
25*c*: outlet hole
25*d*: bypass flow path extending portion
26: valve seat
27: back pressure chamber
28: hole
30: sub-valve unit
31: sub-valve body
50: generating unit
51: rotary shaft
52: impeller
53: impeller cover
60: reverse flow prevention valve
65: manual valve unit
65*a*: manual operating switch
70: control device
71: controller
72: secondary battery
73: body detecting sensor
A: primary side flow path
B: secondary side flow path
h: distance

The invention claimed is:

1. A flush valve configured to be connected to sanitary equipment, the flush valve comprising:

a main valve unit for causing a main valve body to reciprocate between a closed position and an open position in response to pressure in a back pressure chamber communicating with a primary side flow path, thereby opening and closing a flow path between the primary side flow path and the secondary side flow path;

a sub-valve unit having a sub-valve body for opening and closing a bypass flow path connecting the back pressure chamber and the secondary side flow path; and a pressure loss member, disposed on the downstream side of the main valve body and serving as flow resistance on the secondary side flow path;

wherein the bypass flow path is connected to the secondary side flow path such that the bypass flow path merges with the secondary side flow path on the downstream side of the pressure loss member.

2. The flush valve of claim 1, further comprising a reverse flow prevention valve to prevent reverse flow to the pressure loss member;

wherein the bypass flow path is connected to the secondary side flow path between the pressure loss member and the reverse flow prevention valve.

3. The flush valve of claim 1, wherein the volume of the bypass flow path is larger than the reduced-volume of the back pressure chamber, which reduces due to movement of the main valve body-from the closed position to the open position.

4. The flush valve of claim 1, wherein the bypass flow path is connected to the secondary side flow path only downstream of the pressure loss member.

5. The flush valve of claim 1, wherein the pressure loss member is an electrical generating unit comprising:

an impeller, disposed inside the secondary side flow path and capable of rotating about a rotary shaft extending across the secondary side flow path;

a flow deflector for causing the flow out of the main valve unit to impact on one side of the impeller relative to the rotary shaft as seen from the upstream side; and an impeller cover for covering the other side of the impeller relative to the rotary shaft; and configured to generate electricity through the rotation of the impeller;

wherein the bypass flow path is connected to the secondary side flow path on the other side of the impeller, where the impeller cover is disposed.

* * * * *